US010173446B2

(12) United States Patent
Sekino et al.

(10) Patent No.: US 10,173,446 B2
(45) **Date of Patent: *Jan. 8, 2019**

(54) PRINTER

(71) Applicant: TOSHIBA TEC KABUSHIKI KAISHA, Tokyo (JP)

(72) Inventors: Toshiharu Sekino, Shizuoka (JP); Hiroyuki Taki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/231,972

(22) Filed: Aug. 9, 2016

(65) Prior Publication Data

US 2016/0347100 A1 Dec. 1, 2016

Related U.S. Application Data

(60) Division of application No. 15/019,174, filed on Feb. 9, 2016, now Pat. No. 9,682,581, which is a (Continued)

(51) Int. Cl.
*B41J 15/04* (2006.01)
*B41J 15/02* (2006.01)
(Continued)

(52) U.S. Cl.
CPC ..... *B41J 15/042* (2013.01); *B41J 2/01* (2013.01); *B41J 2/32* (2013.01); *B41J 3/60* (2013.01);
(Continued)

(58) Field of Classification Search
CPC ... B41J 15/042; B41J 29/02; B41J 2/32; B41J 2/01; B41J 11/04; B41J 15/044; B41J 15/04; B41J 3/60; B41J 15/02
See application file for complete search history.

(56) References Cited

U.S. PATENT DOCUMENTS 5,764,263 A 6/1998 Lin
7,708,360 B2 5/2010 Byerly et al.
(Continued)

FOREIGN PATENT DOCUMENTS

JP 2010-145238 7/2010
JP 2011-173621 9/2011
JP 2011-255681 12/2011

OTHER PUBLICATIONS

Molecular Imprints :: Technology and Applications : Jet and Flash™; http://www.molecularimprints.com/technology/j_fil_overview.php.

*Primary Examiner* — Justin Seo

(74) *Attorney, Agent, or Firm* — Patterson & Sheridan, LLP

(57) ABSTRACT

According to one embodiment, a printer includes a housing that has an outlet, a drawer unit, first, second and third print medium support units and a printing unit. The drawer unit slides in the outlet between an open position and a closed position. The first supporting unit is disposed in the drawer unit and supports a roll of printable media when the drawer unit is in the open position so that an outer surface of the roll of printable media does not extend above the height of the outlet. The second supporting unit is disposed in the housing and rotatably supports the roll of printable media when the drawer unit is in the closed position so that a portion of the outer surface of the roll of printable media extends above the height of the outlet. The printing unit prints on printable media fed from the roll of printable media.

1 Claim, 4 Drawing Sheets

Related U.S. Application Data continuation of application No. 13/854,766, filed on Apr. 1, 2013, now Pat. No. 9,283,784.

(60) Provisional application No. 61/619,354, filed on Apr. 2, 2012.

(51) Int. Cl.

| | |
|---|---|
| ***B41J 3/60*** | (2006.01) |
| ***B41J 11/04*** | (2006.01) |
| ***B41J 2/01*** | (2006.01) |
| ***B41J 2/32*** | (2006.01) |
| ***B41J 29/02*** | (2006.01) |

(52) U.S. Cl.

CPC ..... *B41J 11/04* (2013.01); *B41J 15/02* (2013.01); *B41J 15/04* (2013.01); *B41J 15/044* (2013.01); *B41J 29/02* (2013.01)

(56) References Cited

U.S. PATENT DOCUMENTS

| | | | | |
|---|---|---|---|---|
| 8,052,414 | B2 | 11/2011 | Wakamatsu et al. | |
| 9,682,581 | B2 * | 6/2017 | Sekino | B41J 3/60 |
| 2006/0266863 | A1 | 11/2006 | Takasu | |
| 2009/0039140 | A1 | 2/2009 | Bezama et al. | |
| 2010/0252188 | A1 | 10/2010 | Inanami et al. | |
| 2011/0076084 | A1 * | 3/2011 | Kasugai | B41J 3/4075 400/613 |
| 2011/0206439 | A1 | 8/2011 | Takahashi | |
| 2013/0293655 | A1 | 11/2013 | Sekino et al. | |
| 2017/0326891 | A1 * | 11/2017 | Sekino | B41J 15/042 |

* cited by examiner

PRINTER

CROSS-REFERENCE TO RELATED APPLICATIONS

This application is a division of co-pending U.S. patent application Ser. No. 15/019,174, filed on Feb. 9, 2016, which is a continuation of U.S. patent application Ser. No. 13/854,766, filed on Apr. 1, 2013, now U.S. Pat. No. 9,283,784, issued on Mar. 15, 2016, which is based upon and claims the benefit of priority from U.S. Provisional Patent Application No. 61/619,354, filed on Apr. 2, 2012, the entire contents of each of which are incorporated herein by reference.

FIELD

The embodiments described herein relate generally to a printer.

BACKGROUND

A housing of a printer, that performs printing on a belt-shaped paper medium drawn from one end of a roll of paper, includes a box-shaped drawer unit. A hopper is fixed inside of the drawer unit to provide support to the roll of paper so that the roll of paper can rotate.

The following problems can arise if the roll of paper is set in the hopper in such a way that the lower end of the roll of paper comes into contact with the lower surface of the drawer unit or hopper. Friction can occur between the lower end of the roll of a paper and the lower surface of the drawer unit if the roll rubs against an adjacent surface during unrolling of the paper therefrom. This friction generates heat, which can be sufficient to discolor or blacken the heat sensitive paper on the roll. Additionally, scratches can occur on the paper due to the rubbing of the paper against adjacent surfaces when the paper roll is rotated to pull a sheet. That is to say, if the roll of a paper is set in such a way that the lower end of the roll of paper comes into contact with the lower surface of the drawer unit, it becomes difficult to effectively maintain the quality of the roll of paper.

To effectively maintain the quality of the roll of paper in the conventional printer, the roll of paper is set in such a way that the lower end of the roll of paper lies in the upper portion of the drawer unit so as to separate the lowermost surface of the roll of paper from the lower surface of the drawer unit. That is to say, in the conventional printer, the hopper is set in such a way that the lower end of the roll of paper lies in a location that is elevated off the lower surface of the drawer unit.

However, in a conventional printer, a problem can arise if a roll of a paper with a large diameter is placed in the hopper and the roll protrudes above the drawer unit or into the upper portions of the drawer unit, because the roll of paper may interfere with structural portion of the housing as the drawer unit is being closed. As a result, in a conventional printer, the roll of paper capable of fitting without causing interference upon closing has a small diameter and thus is quickly consumed, necessitating frequent replacement of the roll.

DETAILED DESCRIPTION

Figure 1:
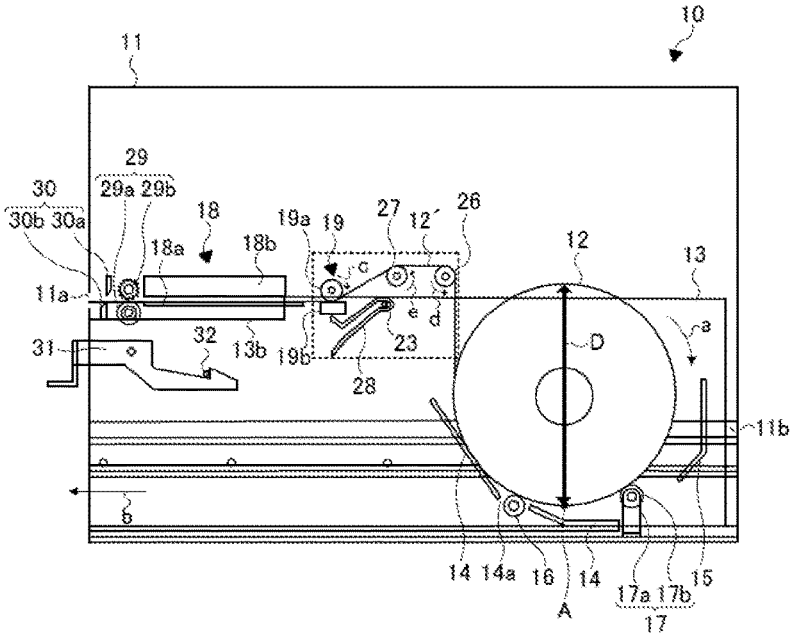
FIG. 1 is a schematic configuration showing a printer according to an embodiment.

In general, embodiments of the invention provide a printer that can effectively maintain the quality of a rolled print medium while enabling use of an enlarged diameter of the rolled print medium, and thus increase the length of paper that can be used in the printing apparatus before the roll must be replaced. FIG. 1 is a schematic configuration showing a printer according to this embodiment. In the embodiment, the roll of paper is loaded into the hopper in a position where the lowermost surface of the roll is in contact with the base of the drawer, but, after the roll has passed the underside of the opening of the housing within which the drawer slides, the roll is lifted off of the base of the drawer. Thus, a larger roll of paper may be accommodated, but deterioration of the paper caused by rubbing of the paper against the base of the drawer is eliminated. In general, embodiments herein provide a printer that can effectively maintain the quality of a rolled print medium while enabling enlarging of the rolled print medium diameter. FIG. 1 is a schematic configuration showing a printer according to this embodiment.

According to an embodiment of the invention, a printer includes a housing having an outlet and a drawer unit, a first print medium supporting unit, a second print medium supporting unit, a third print medium supporting unit each of which are configured for supporting the roll of print media, and a printing unit. The drawer unit is placed inside of the housing in such a way that it can be pulled from, and returned into, the housing. The first and second print medium supporting units are attached to the drawer unit in such a way that at least one can move with respect to the other. The third print medium supporting unit is fixed to the housing in such a way that it can be arranged in between the lower ends of the first print medium supporting unit and second print medium supporting unit. The printing unit is configured to print on a strip of print medium drawn or pulled from the roll of print medium, which roll is supported in such a way that it can rotate with the assistance of at least the first print medium supporting unit.

In the printer 10 shown in FIG. 1, a roll of print medium is formed by winding a strip of print medium in a rolled shape, and is located inside of a housing 11, and printing can be performed on both the sides of the strip of print medium drawn from the rolled print medium. In the following, a roll of print medium is designated as roll of paper 12 and the strip of print medium pulled therefrom as a strip of paper 12'.

The housing 11 includes located therein, during printing on the roll of paper 12, a print medium support unit, which is a hopper that supports the rolled paper 12 in such a way that the roll of paper 12 can rotate in the direction shown by the arrow "a" in the figure; a feed unit that feeds the strip of paper 12' drawn from the roll of paper 12; and a printing unit that performs the printing operation on the strip of paper 12' drawn from the roll of paper 12 passing or positioned therein. Moreover, the housing 11 is configured in such a way that it can be drawn out of the housing 11 in the given direction (for example, the direction of arrow b in the figure). In the upper direction of the housing 11, there is a drawer unit 13, which is an open top, generally box-shaped drawer. The drawer unit 13 is set up in such a way that it can be moved with respect to the housing 11 on a rail 11*b* fixed to the base of the housing 11.

The print medium support unit contains a hopper front guide 14, which is the first print medium supporting unit, and a hopper rear guide 15, which is the second print medium supporting unit. The hopper front guide 14 and the hopper rear guide 15 are attached to the drawer unit 13. The hopper front guide 14 and the hopper rear guide 15 separate from each other, i.e., can move with respect to one another to change the paper roll 12 receiving area or open space. The guides 14, 15, are generally arranged at an angle to the horizontal, or to the base of the housing 11, in such a way that the gap between the guides increases in the vertical direction, i.e., the distance from the base of the housing 11 increases, forming an open space formed between the guides 14, 15. The rolled paper 12 is placed in the thus formed open space.

The hopper front guide 14 is set in such a way that a portion of it, including its lower end, comes in contact with the bottom surface of the drawer unit 13, and the remainder thereof extends upwardly therefrom and in the direction of the front of the housing (direction "b").

Furthermore, the hopper front guide 14 contains an opening 14*a*. A hopper front roller 16 is positioned in this opening 14*a*. The hopper front roller 16 allows rotation of the roll of paper 12 freely thereon, as well as spaces the surface of the roll of paper 12 from the front guide 14, and thus reduces the deterioration in the quality of the rolled paper 12 which would result from frictional contact between the rolled paper 12 and the hopper front guide 14.

The hopper rear guide 15 is set in such a way that its upper end is separated from the hopper front guide 14 and is separated from the bottom surface in the upper direction of the drawer unit 13.

Moreover, the print medium supporting unit has a supporting roller 17*a*, which is the third print medium supporting unit 17 positioned on a roller supporting unit 17*b*. The third print medium supporting unit 17 is fixed to the housing in such a way that it is placed in a gap between the lower end of the hopper front guide 14 and the lower end of the hopper rear guide 15 and in such a way that the supporting roller 17*a* extends into the gap formed by the hopper front guide 14 and the hopper rear guide 15.

The hopper supporting roller 17*a*, which is supported on a roller support 17*b*, is positioned such that when the drawer unit 12 approaches a fully seated, i.e., fully closed, position, the roll of paper 12 slides on the roller 17*a* and the roller 17*a* lifts the roll of paper 12 off of rear guide 15, and the roll of paper becomes supported only on rollers 16, 17 as shown in FIG. 1. Furthermore, the hopper rear roller 17*a*, in conjunction with the hopper front roller 16, allows free rotation of roll of paper 12 located thereon and thus minimizes the deterioration in the quality of the rolled paper 12, which would be caused as a result of the friction between the rolled paper 12 and the third print medium supporting unit 17 absent roller 17*a*.

The hopper rear roller support 17*b*, which is the roller supporting unit 17*b*, rotatably supports the hopper rear roller 17*a*. The hopper rear roller support 17*b*, extends upwardly from, and is fixed to the bottom surface of the housing 11.

Figure 2:
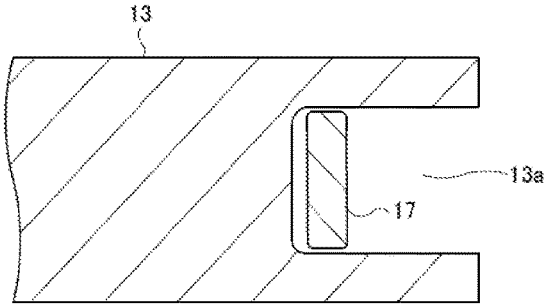
FIG. 2 is a diagram showing the positional relationship between the bottom surface of a drawing unit and a third printing medium supporting unit according to an embodiment.

FIG. 2 is a diagram showing the positional relationship between the bottom surface of the drawer unit 13 and the third print medium supporting unit 17. As shown in FIG. 2, a second opening or slot 13*a* is present in the lower end of the drawer unit 13. This second opening 13*a* provides clearance for the inner ends of the drawer unit to slide past the print medium supporting unit 17 during opening and closing of the drawer unit. That is to say, the third print medium supporting unit 17 is fixed to the lower end of the housing 11; along with that, when the drawer unit 13 is placed inside of the housing 11, the third print medium supporting unit 17 is exposed and extends into the internal portion of the drawer unit 13 through the second opening 13*a* of the drawer unit 13.

Once again referring to FIG. 1, the printing unit that performs printing on the strip of paper 12' drawn from the roll of paper 12, contains a first printing unit 18 that prints on the surface of the strip of paper 12' and a second printing unit 19, which prints on the back surface of the strip of paper 12'.

The first printing unit 18 is provided in the vicinity of an outlet 11*a* of the housing. This outlet 11*a* is set up on one end or side of the housing 11. The first printing unit 18 is a printing unit that performs the printing by the ink-jet method on the surface of the strip of paper 12', and it contains a paper guide 18*a* and an inkjet head 18*b*.

The paper guide 18*a* is fixed to the drawer unit 13 in such a way that it is exposed by a cut-out portion 13*b* in the upper side walls of the front end of the drawer unit 13. Moreover, the strip of paper 12' is placed in the upper surface of the paper guide 18*a*.

The inkjet head 18*b* is placed at a position that overlies the upper surface of the paper guide 18*a*, and the position is also located above the drawer unit 13 in the housing 11 when the drawer unit 13 is placed inside of the housing 11. The inkjet head 18*b* performs printing by the inkjet method on the strip of paper 12' located on the paper guide 18*a*.

The second printing unit 19 is provided at a position located between the print medium support unit and the first printing unit 18 in the feeding path of the strip of paper 12'. The second printing unit 19 is a printing unit that performs printing on the back surface of the strip of paper 12' by a thermal-type method, and it contains a platen roller 19*a* and a thermal head 19*b*.

The platen roller 19*a* is fixed in the housing 11 at a position that is roughly in the upper direction from the drawer unit 13. At the time of performing the printing by the thermal method, the thermal head 19*b* is pushed inside the platen roller 19*a* through the strip of paper 12'.

The thermal head 19*b* is located in the drawer unit 13 at a position that is opposed to the platen roller 19*a*; along with that, it is positioned in such a way that it does not protrude above the side of the drawer unit 13. The thermal head 19*b* performs printing on the strip of paper 12' held thereagainst by roller 19*a* by a thermal-type printing method.

Figure 3:
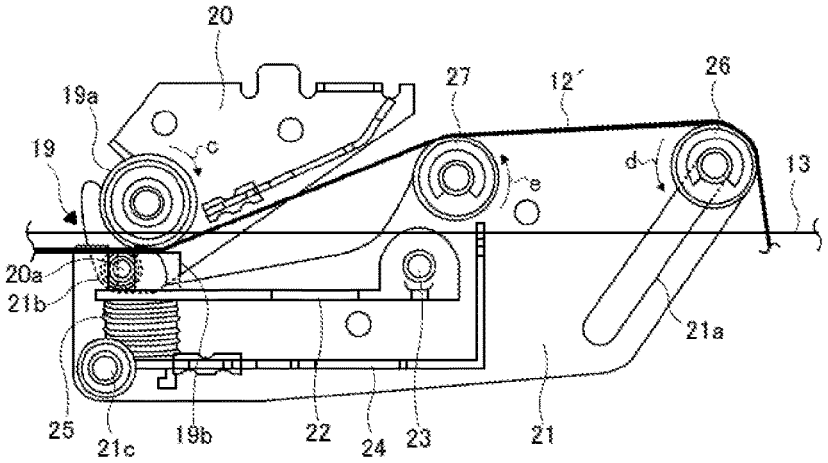
FIG. 3 is a diagram showing the section of FIG. 1 marked with a dotted line by enlarging it according to an embodiment.

FIG. 3 is a diagram showing an enlarged portion of the printer within the dotted line in FIG. 1. It also shows the structure of the second printing unit 19 and the area surrounding it. As shown in FIG. 3, the platen roller 19*a* is fixed to the housing 11 by way of rotatably connecting it to a platen frame 20, which, in turn, is fixed to the housing of the printer 11, so that the platen roller 19*a* can rotate in the direction of arrow c shown in the figure.

The thermal head 19*b* is secured on one end of a head support 22 of the head block 21 provided in the drawer unit 13 and, the other end of the head support 22 is located on, and may arcuately swing with respect to, a head support rotation shaft 23. Referring still to FIG. 3, an L shaped head frame 24 is located below the head support 22. Above one end of the L shaped head frame 24, a compressed spring 25 is provided as an elastic biasing element to press against the underside of the head support and thus bias the thermal head 19*b* located on the head support 22 against the platen roller 19*a* when the drawer unit 13 is in a closed position on the housing 11. Moreover, the head block 21 is provided with a damper roller 26 and a guide roller 27, which feed the strip of paper 12' drawn from the rolled paper 12. The damper roller 26 can be positioned alongside of a long hole 21*a* set up in the head block 21, and it is set up in such a way that it can also rotate in the direction of the arrow d shown in the figure. Moreover, a guide roller 27 is provided in the head block 21 in such a way that it can rotate in the direction of the arrow e shown in the figure.

Furthermore, the head block 21 contains a slot portion 21*b* for positioning it with respect to the platen frame 20. The platen frame 20 contains a joining axle or shaft 20*a* over which the slot portion 21*b* maybe slid to create the relative positioning, which allowing movement therebetween. As shown in the figure, the joining axle 20*a* of the platen frame 20 is joined and set in the cut-out portion 21*b* of the head block 21; thus, the head block 21 and the platen frame 20 are mutually engaged, and the thermal head 19*b* is able to bear against the platen roller 19*a*.

Figure 4:
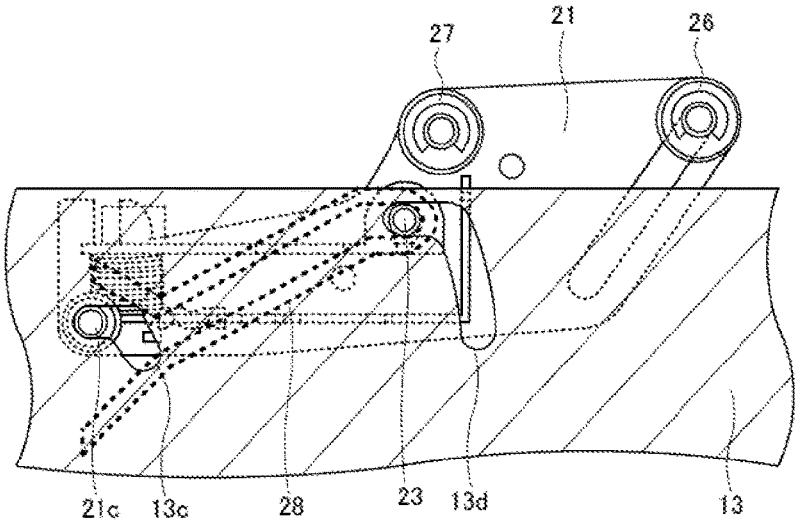
FIG. 4 is a diagram showing the relationship between a head block and the drawing unit according to an embodiment.

FIG. 4 is a diagram showing the relationship between the head block 21 and the drawer unit 13. As shown in FIG. 4, the head block 21 is partly provided with a head block rotation axle or shaft 21*c*. Moreover, at one side of the drawer unit 13, a first dog-leg shaped hole 13*c* into which the head block rotation axle or shaft 21*c* extends, and a second longer dog-legged hole 13*d* into which the head support rotation shaft 23 extends, are provided in the side wall of the drawer unit 13. The head block 21 is set in the drawer unit 13 in such a way that the head block rotation axle or shaft 21*c* can move along or slide in the first hole 13*c* and the head support rotation shaft 23 can move or slide along the second longer hole 13*d*.

When the drawer unit 13 is moved into the housing 11, along with the movement of the drawer unit 13, the head support rotation shaft 23 of the head block 21 rides slides a guide unit 28 to ascend and slide along the path of the longer hole 13*d*. At this time, the head block rotation axis 21*c* moves to the upper end of the first hole 13*c*, and the head support rotation shaft 23 moves to the upper end of the second longer hole 23*d*. Due to this motion, the portion of the head block 21 that includes the damper roller 26 and the guide roller 27 moves to an exposed position, which is above the upper surface of the side of the drawer unit 13, and the thermal head 19*b* is engaged against the platen roller 19*a*.

Referring again to FIG. 1, at a location between the first printing unit 18 and the outlet 11*a* of the housing 11, a pair of discharge rollers 29 is provided. This pair of discharge roller includes a portion of the feeding unit that feeds the strip of paper 12' to the outlet 11*a*. The pair of discharge rollers 29 includes of a discharge roller 29*a*, which rotates in the given direction due to the rotational driving thereof by a motor (not shown) , and a pinch roller 29*b*, which, in turn, rotates by being driven by the rotation of the discharge roller 29*a*. The pinch roller 29*b* is rotationally fixed in place on the housing 11; when the drawer unit 13 is placed inside of the housing 11, the discharge roller 29*a*, which is rotationally fixed on the drawer unit 13, is positioned in opposition to, and engaged against (in the absence of paper therebetween), the pinch roller 29*b*.

Upstream, in a paper path direction, of the discharge rollers 29, and the printing unit 18, are located the damper roller 26 and the guide roller 27, and the platen roller 19*a* of the second printing unit. The platen roller 19*a* is, as with the discharge roller 29*a*, driven to rotate by a motor (not shown) in the direction "c". In turn, the damper roller 26 and the guide roller 27 rotate due to the rotation of the platen roller 19*a* and the discharge roller 29*a* pulling the sheet of paper 12' therepast.

A cutting unit 30 is positioned between the location of the pair of discharge rollers 29 and the housing outlet 11, to cut the strip of paper 12' upon which printing has been performed into individual sheets of paper. The cutting unit 30 contains an upper cutting unit 30*a* and a lower cutting unit 30*b*. The upper cutting unit 30*a* is fixed to the housing 11; when the drawer unit 13 is pushed or placed fully within the housing 11, the lower cutting unit 30*b* is positioned opposed from the upper cutting unit 30*a*. The printer 10 performs the printing as follows. For example, when a printing command is received from a CPU (not shown in the figures, a printing operation is done by the thermal head 19*b* on the back surface of the strip of paper 12', which is placed in between the platen roller 19*a* and the thermal head 19*b* of the second printing unit 19.

The strip of paper 12', on the back surface of which the printing is done, is then fed in the upper surface of the paper guide 18*a* of the first printing unit 18 due to the rotation of the platen roller 19*a*. In the first printing unit 18, a printing operation is performed by the inkjet head 18*b* on the surface of the strip of paper 12' located on the upper surface of the paper guide 18*a*.

The strip of paper 12' for which the printing is done on both the surfaces is discharged from the outlet 11*a* of the housing 11 by the pair of discharge rollers 29 and is cut by the cutting unit 30.

Figure 5:
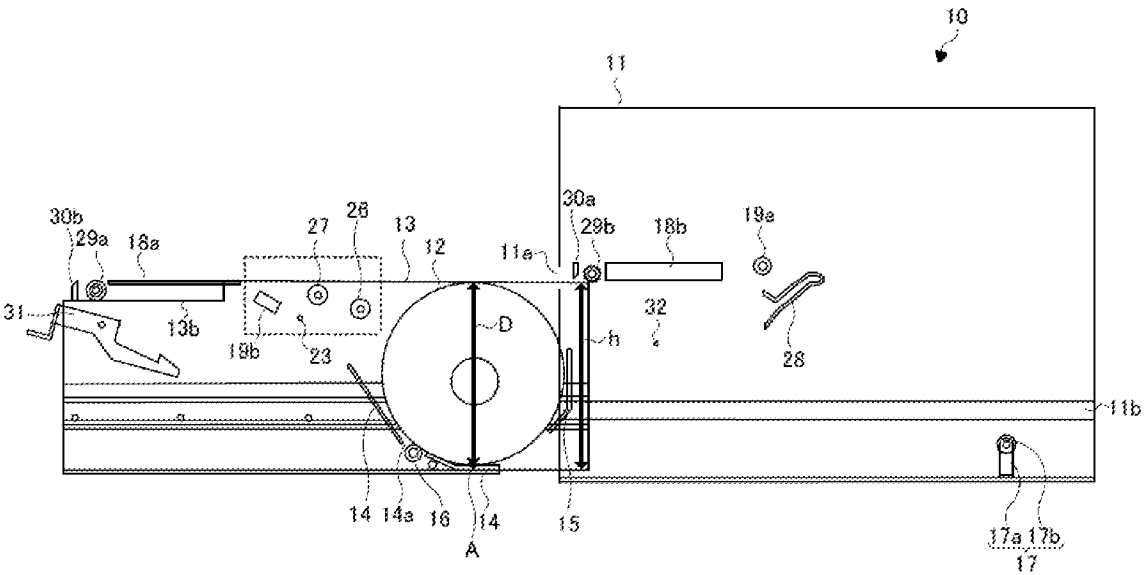
FIG. 5 is a schematic configuration showing the printer in a state wherein the drawing unit is drawn from a housing of the printer according to an embodiment.
Figure 6:
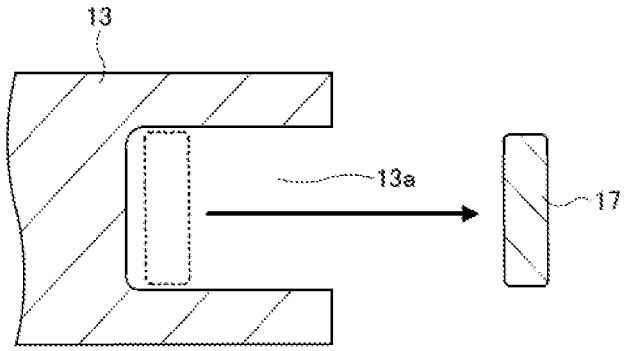
FIG. 6 is a diagram showing the positional relationship between the drawing unit and the third printing medium supporting unit in a state wherein the drawing unit is drawn from the housing of the printer according to an embodiment.

FIG. 5 is a schematic configuration showing the printer 10 of this embodiment in the state wherein the drawer unit 13 is positioned open with respect to the housing 11; FIG. 6 is a diagram showing the positional relationship between the drawer unit 13 and the third print medium supporting unit 17 during the closing of the drawer unit 13. Moreover, FIG. 7 is a diagram that shows the portion of FIG. 5 shown by the dotted line in FIG. 5 in an enlarged state, and it also shows the relationship between the head block 21 and the drawer unit 13.

In the printer 10, the drawer unit 13 is opened by moving a hook arm 31 to unfastened from a lock unit 32 that is held in the housing 11, to enable the drawer unit 13 to be pulled from the housing 11, and the third print medium supporting unit 17 fixed to the housing 11 remains in the housing 11 (FIG. 5 and FIG. 6); each part of the apparatus described herein as attached to the drawer unit 13, along with the drawer unit 13, is drawn out from the inner portion of the housing 11 (FIG. 5) to the positions shown in FIG. 5.

Figure 7:
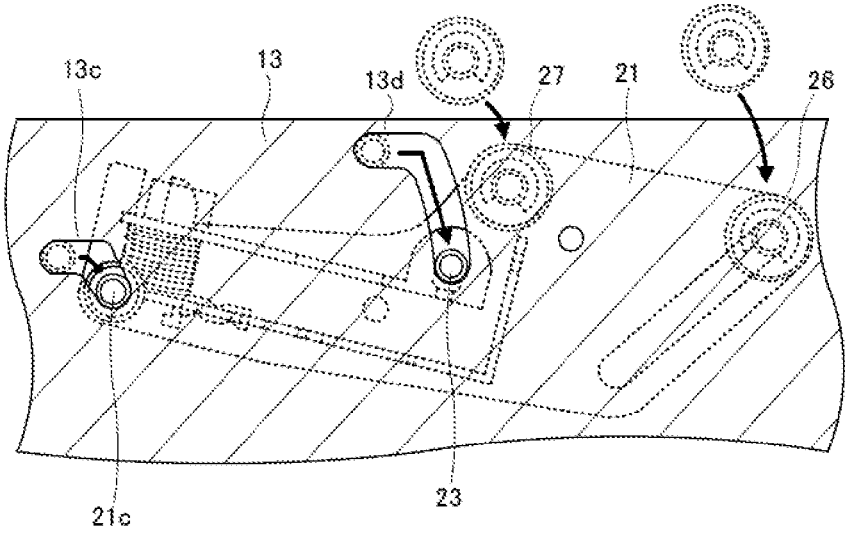
FIG. 7 is a diagram showing the section surrounded by the dotted lines of FIG. 5 by enlarging it according to an embodiment.

As shown in FIG. 7, along with the of this drawer unit 13 from the closed to the open position, the head support rotation shaft 23 of the head block 21 slides down along the guide unit 28 (FIG. 5) secured on the housing 11 alongside of the guide unit 28. The head support rotation shaft 23 separates from the guide unit 28. As a result, the head block 21 may move in the downward direction, and the head block rotation axle or shaft 21*c* moves to the lower end of the first hole 13*c* of the drawer unit 13. The head support rotation shaft 23 moves to the lower end of the second longer hole 13*d* of the drawer unit 13. As a result, the entire head block 21 containing damper roller 26 and guide roller 27 moves in a position where does not extend above the upper side surface of the drawer unit 13. In other words, the head block 21 is moved to the position where the draw-out operation from the housing 11 of the drawer unit 13 and storage to the housing 11 of the drawer unit 13 is not obstructed.

As shown in FIG. 5, after pulling the drawer unit 13 to the open position, if the roll of paper 12 is arranged inside of the space formed by the hopper front guide 14 and the hopper rear guide 15, the rolled paper 12 is supported by the hopper front guide 14 and the hopper rear guide 15. In this case, the lower end A of the rolled paper 12 comes in contact with the portion of the hopper front guide 14 that touches the bottom surface of the drawer unit 13. In other words, the lower end A of the rolled paper 12 is arranged in such away that it touches the bottom surface of the drawer unit 13 through the portion of the hopper front guide 14. Therefore, even if the rolled paper 12 of a large diameter D, which corresponds to the full height h of the drawer unit 13, is placed in the hopper, protrusion of the roll of paper 12 from the drawer unit 13 in the upper direction does not occur.

After arranging the rolled paper 12 of such a large diameter, the drawer unit 13 is closed into the housing 11. In this storage operation, as the drawer unit 13 is moved into the housing 11, the rolled paper 12 move in the same direction along with the drawer unit 13. In this operation, since the upper portion of the rolled paper 12 does not protrude from the drawer unit 13 in the upper direction, interference between the rolled paper 12 and the housing 11 is prevented.

As the drawer unit 13 is moved into the housing 11, the roll of paper 12 comes in contact with the third print medium supporting unit 17 fixed inside of the housing 11, as shown in FIG. 1, and is lifted on the roller 17*a* thereof off of the second guide 15, and the lower end A of the roll of paper 12 is separated from the hopper front guide 14 the bottom surface of the drawer unit 13 (FIG. 1).

According to the printer described in the embodiment previously explained, in the state where the drawer unit 13 is pulled out from the housing 11, the roll of paper 12, placed in between the hopper front guide 14 and the hopper rear guide 15 of the drawer unit 13, is arranged in such a way that its lower end A comes in contact with the bottom surface of the drawer unit 13 through the portion of the hopper front guide 14. Therefore, even if the rolled paper 12 with a large diameter D that corresponds to the height h of the drawer unit 13 is placed in between the hopper front guide 14 and the hopper rear guide 15, protrusion of the rolled paper 12 from the drawer unit 13 in the upper direction is suppressed. As a result, the rolled paper 12 and the housing 11 do not interfere, and the drawer unit 13 cannot be stored inside the housing 11.

Furthermore, if the drawer unit 13 is stored inside of the housing 11, the third print medium supporting unit 17 moves the roll of paper 12 upwardly to separates the lower end A of the roll of paper 12 from the portion of the hopper front guide 14 that comes in contact with the bottom surface of the drawer unit 13. Therefore, even if the rolled paper 12 is then rotated, the quality of the rolled paper 12 can be successfully maintained.

In short, according to the printer 10 described in this embodiment, the quality of the rolled paper 12 can be successfully maintained, and the diameter D of the rolled paper 12, which can be loaded, can be enlarged.

While certain embodiments have been described, these embodiments have been presented by way of example only, and they are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

a housing with an outlet having a height h;

a drawer unit slidable in the outlet between an open position and a closed position;

a first supporting unit disposed in the drawer unit and configured to support a roll of printable media having a diameter D equal to or less than the height h, the first supporting unit supporting the roll of printable media when the drawer unit is in the open position so that an outer surface of the roll of printable media does not extend above the height h of the outlet, wherein the first supporting unit includes a roller adapted to support the roll of printable media at the outer circumference of the roll of printable media disposed in the drawer unit when the drawer unit is in the closed position;

a second supporting unit disposed in the housing and configured to rotatably support the roll of printable media when the drawer unit is in the closed position so that a portion of the outer surface of the roll of printable media extends above the height h of the outlet; and a printing unit configured to print on printable media fed from the roll of printable media.

* * * * *